US009021726B2

(12) United States Patent
Glass et al.

(10) Patent No.: US 9,021,726 B2
(45) Date of Patent: May 5, 2015

(54) SLIDING PANEL GIFT CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/292,988

(22) Filed: Nov. 9, 2011

(65) Prior Publication Data

US 2012/0205281 A1 Aug. 16, 2012

Related U.S. Application Data

(60) Provisional application No. 61/411,919, filed on Nov. 9, 2010.

(51) Int. Cl.

| | |
|---|---|
| ***G09F 1/00*** | (2006.01) |
| ***B42D 15/08*** | (2006.01) |
| ***B65D 27/00*** | (2006.01) |
| *B42D 25/20* | (2014.01) |

(52) U.S. Cl.

CPC ..... *B42D 15/08* (2013.01); *B65D 27/00* (2013.01); *B42D 25/285* (2014.10)

(58) Field of Classification Search

USPC ..... 40/124.06; 206/804; 229/92.8, 70

See application file for complete search history.

(56) References Cited

U.S. PATENT DOCUMENTS

| | | | | |
|---|---|---|---|---|
| 639,679 | A | 12/1899 | Kaufmann | |
| 2,884,724 | A | 5/1959 | Lohnes et al. | |
| 3,199,238 | A | 8/1965 | Brown | |
| 3,288,350 | A * | 11/1966 | Kushner | 229/70 |
| 3,848,348 | A | 11/1974 | Hawley | |
| 4,697,364 | A | 10/1987 | Dean | |
| 6,418,648 | B1 | 7/2002 | Hollingsworth et al. | |
| 6,732,459 | B1 | 5/2004 | Clark | |
| 6,877,263 | B2 | 4/2005 | Clark | |
| 7,056,122 | B2 | 6/2006 | Lockett | |
| D532,452 | S | 11/2006 | Heng et al. | |
| D619,359 | S | 7/2010 | Pascua et al. | |
| 7,882,651 | B2 | 2/2011 | Wilen | |
| 2004/0093773 | A1 * | 5/2004 | Clark | 40/124.06 |
| 2005/0284927 | A1 | 12/2005 | Wilen | |
| 2006/0064906 | A1 * | 3/2006 | Flemons | 40/124.06 |
| 2006/0101678 | A1 | 5/2006 | Wilen | |
| 2006/0231609 | A1 | 10/2006 | Lazarowicz et al. | |
| 2009/0217559 | A1 | 9/2009 | Sayre | |

FOREIGN PATENT DOCUMENTS

| | | |
|---|---|---|
| CA | 2447733 | 3/2012 |
| WO | 2008020883 | 10/2008 |

* cited by examiner

*Primary Examiner* — Joanne Silbermann
(74) *Attorney, Agent, or Firm* — Polsinelli PC

(57) ABSTRACT

A sliding panel gift card holder includes a panel mounted within a sleeve, pouch or bag, the panel being hingedly connected to a draw flap and then to a cover flap. Upon opening the cover flap, the draw flap draws the panel out of the sleeve to reveal a gift card secured upon the panel, thereby presenting the gift card to a recipient.

12 Claims, 8 Drawing Sheets

SLIDING PANEL GIFT CARD HOLDER

CROSS REFERENCE TO RELATED APPLICATIONS

This application claims the benefit of the prior filed, provisional application Ser. No. 61/411,919, filed Nov. 9, 2010.

BACKGROUND OF THE INVENTION

This invention relates generally to gift card holders and more particularly to a device for holding a gift card or gift card packet while providing graphical and mechanical enhancements to entertain the gift card recipient and add value to the gift, namely a sliding panel for holding a gift card, the panel being mounted in a sleeve, pouch or bag so that when the cover flap is opened the panel is drawn upward and out of the sleeve to reveal a gift card secured upon the panel.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift, and that presents a gift card to a recipient through mechanical linkage with a holder flap, such that, as the gift recipient raises the flap, the gift card is raised out of a holder sleeve, pouch or bag.

BRIEF DESCRIPTION OF THE INVENTION

The purpose of this invention is to provide a holder for receiving and holding a gift card. The gift card holder provides graphical and mechanical enhancements to entertain the gift card recipient and add value to the gift. The gift card holder presents a gift card to a recipient through mechanical linkage with a holder flap such that, as the gift recipient opens the holder by raising the flap, a panel bearing the gift card is raised out of the holder main body, which comprises a sleeve, pouch or bag.

A sliding panel card holder according to the present invention may include a main body, the main body including a sleeve sized to hold a sliding panel therein. The panel is held at least partially within the sleeve when the holder is in a closed position, and preferably is also held at least partially within the sleeve when the holder is in an open position, although to a lesser degree or extent. The panel includes slits or other operable means for removably attaching a card, such as a transaction card, such as a gift card, to the front or outward-facing surface of the panel. A cover flap projects from a rear wall of the sleeve and is hingedly connected thereto. A draw flap projects from the cover flap, at an end of the cover flop opposite its attachment to the sleeve, and is hingedly connected thereto. The panel projects from the draw flap, at an end of the draw flap opposite its attachment to the cover flap, and is hingedly connected thereto. The panel, draw flap and cover flap are thereby connected one to the other in train.

When the cover flap is pivoted away from the main body and from a closed position to an open position, the draw flap follows the cover flap in train and the panel further follows the draw flap in train, thereby sliding at least a portion of the panel out of the sleeve, thereby revealing the card held upon the panel to the user, operator or gift recipient.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
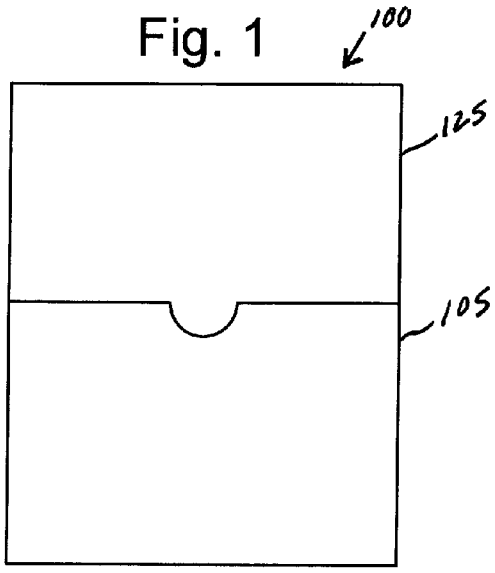
FIG. 1 is a front view of a sliding panel gift card holder showing the cover flap in a closed position.
Figure 2:
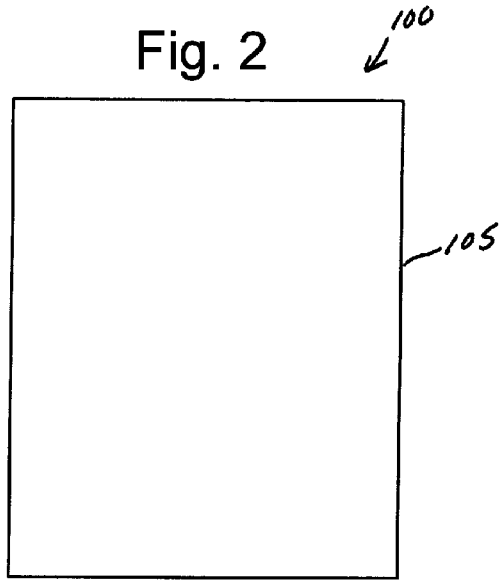
FIG. 2 is a rear view of the holder.

With reference to the figures, FIGS. 1 through 5 illustrate an embodiment of a sliding panel gift card holder 100. The holder 100 comprises a main body 105, which may include a sleeve, pouch or bag 110 for receiving and holding a carrier panel 115. The carrier panel 115 includes slits 120 or other means for removeably attaching a gift card. FIGS. 1 and 2 show front and rear views, respectively, of a sliding panel gift card holder with the cover flap 125 in a closed position. The cover flap 125 is hingedly connected to the rear wall 130 of the main body 105 via a fold line 135 or other means. A draw flap 140 is hingedly connected at the top edge to the forward edge of the cover flap 125. The bottom edge of the draw flap 140 is hingedly connected to the top edge of the carrier panel 115. Thus the draw flap 140 bridges between the cover flap 125 and carrier panel 115 and conveys the motion of a moving cover flap 125, i.e. when manipulated (raised or lowered) by a user, to the carrier panel 115.

Figure 3:
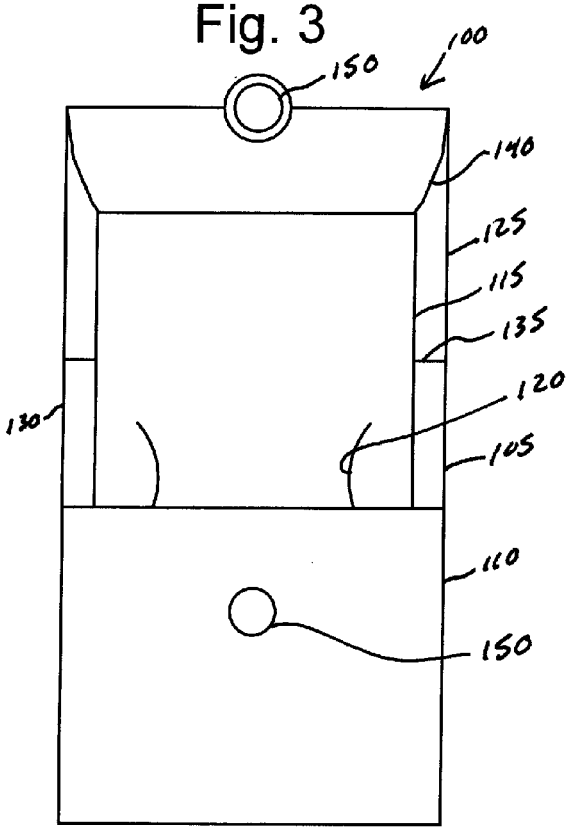
FIG. 3 is a front view of the holder showing the flap opened and the carrier panel withdrawn from the holder main body.
Figure 4:
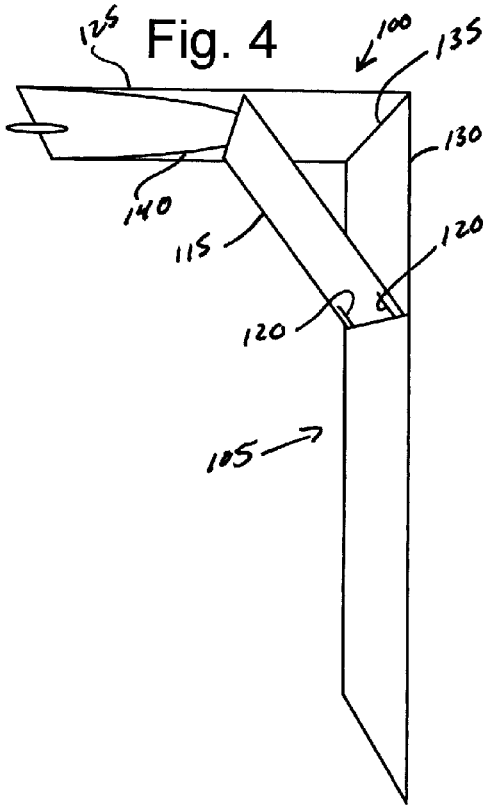
FIG. 4 is a side and partial perspective view showing the holder partially opened.
Figure 5:
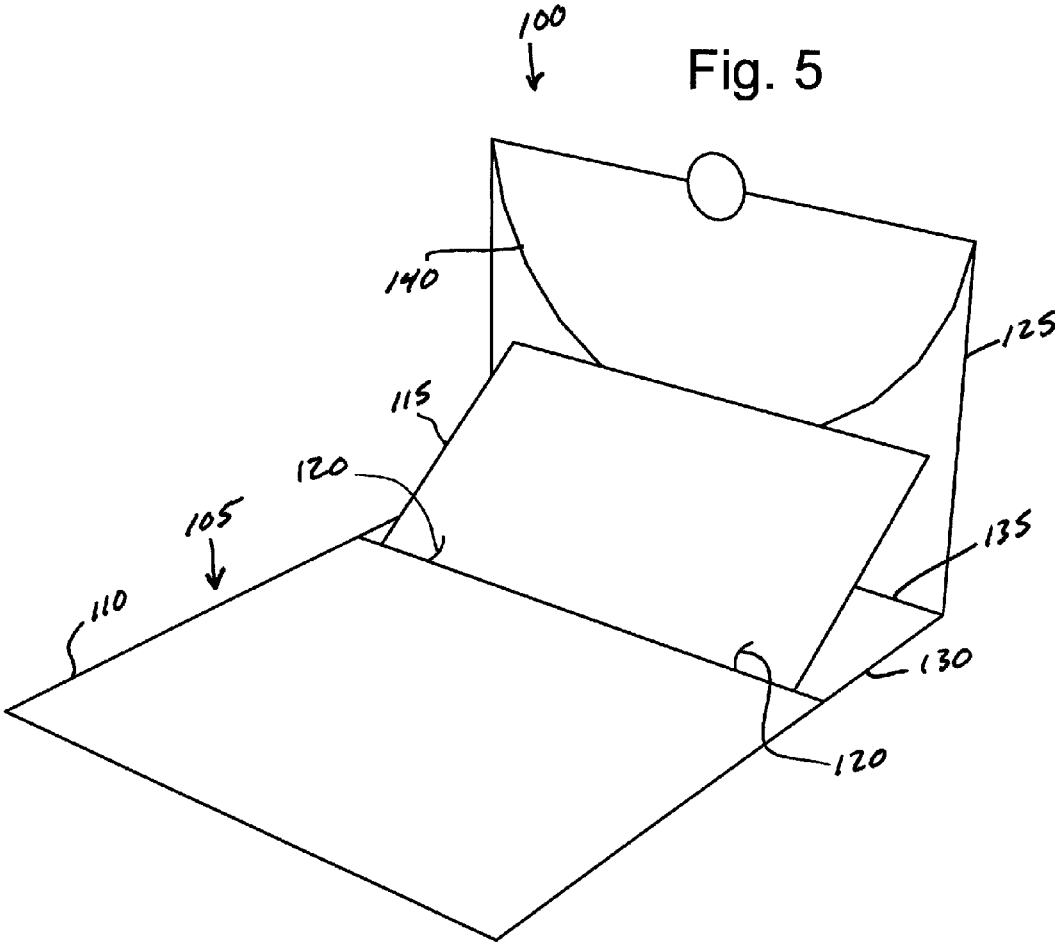
FIG. 5 is a perspective view showing the holder partially opened.

FIG. 3 is a front view of the holder 100 showing the cover flap 125 opened and the carrier panel 115 withdrawn from the holder main body 105. As the front edge of the cover flap 125 is pivoted upward it draws the draw flap 140 upward as well, which in turn causes the carrier panel 115 to advance upward out of the sleeve 110, thereby revealing the gift card held thereon. Closure means, such as hook and loop fasteners 150, are located on the cover flap 125 and main body 105 so that they are in alignment to engage one another when the cover flap 125 is closed, thereby retaining the cover flap 125 in a closed position. FIG. 4 is a side and partial perspective view and FIG. 5 is a perspective view, both showing the holder 100 partially opened. This embodiment of a sliding panel gift card holder 100 does not require a stop mechanism associated with the carrier panel 115 since the carrier panel 115 and draw flap 140 are of sufficient length that the lower portion of the carrier panel 115 remains within the sleeve 110 even when the cover flap 125 is fully opened.

Figure 6:
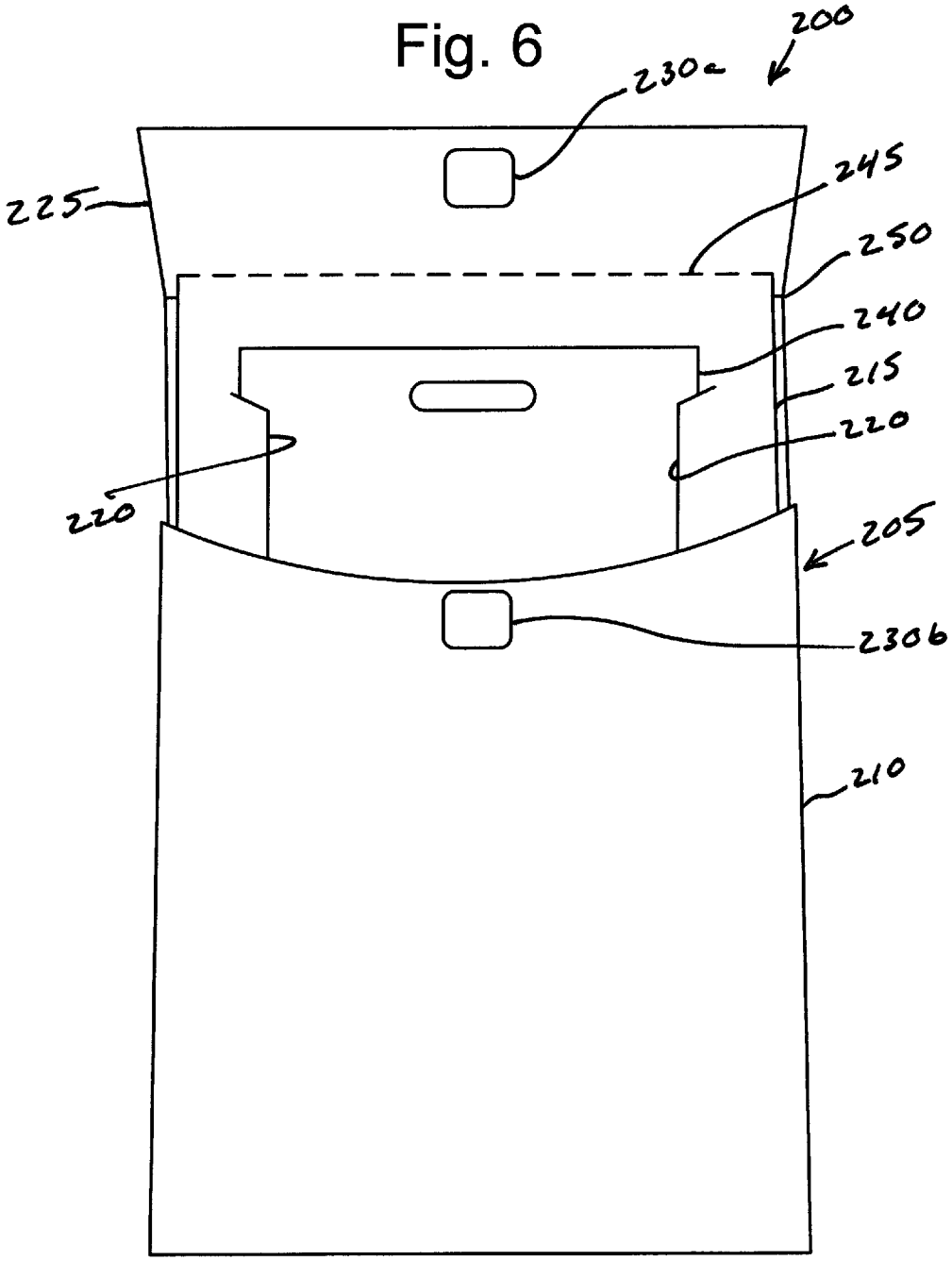
FIG. 6 is a front view of a first alternative embodiment of a sliding panel gift card holder showing the cover flap opened and the carrier panel withdrawn from the holder main body.

FIG. 6 is a front view of a first alternative embodiment of a sliding panel gift card holder 200. The holder 200 comprises a main body 205, which may include a sleeve, pouch or bag 210 for receiving and holding a carrier panel 215. The carrier panel 215 includes slits 220 or other means for removeably attaching a gift card, gift card packet, or other relatively flat device. FIG. 6 shows the cover flap 225 opened and the carrier panel 215 withdrawn from the holder main body 205. Means for retaining the cover flap 225 in a closed position include hook and loop fasteners 230*a* and 230*b*. A cardstock gift card backer sheet 240 (known in the prior art) is shown positioned and held within the slits 220. Two hinge folds are associated with the cover flap 225, namely, the hinge fold 245 between the flap 225 and the carrier panel 215, and the hinge fold 250 between the flap 225 and the main body 205.

Figure 7:
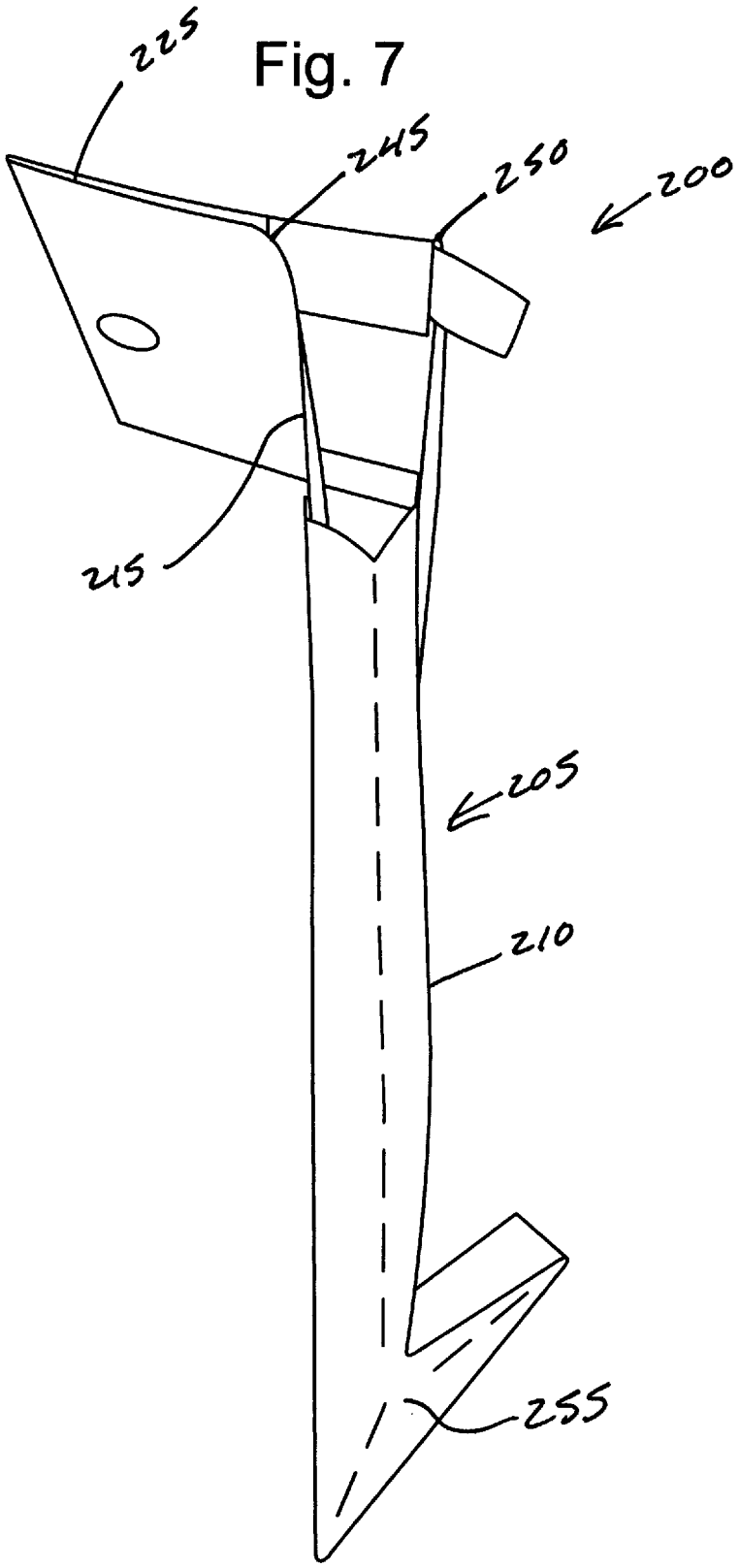
FIG. 7 is a side and partial perspective view showing the holder of FIG. 6 partially opened.

FIG. 7 is a side and partial perspective view of a holder 200 wherein the main body 205 includes a pleated bag 210. As shown, side panels forming bellows 255 extend between the front and back panels of the main body 205.

Figure 8:
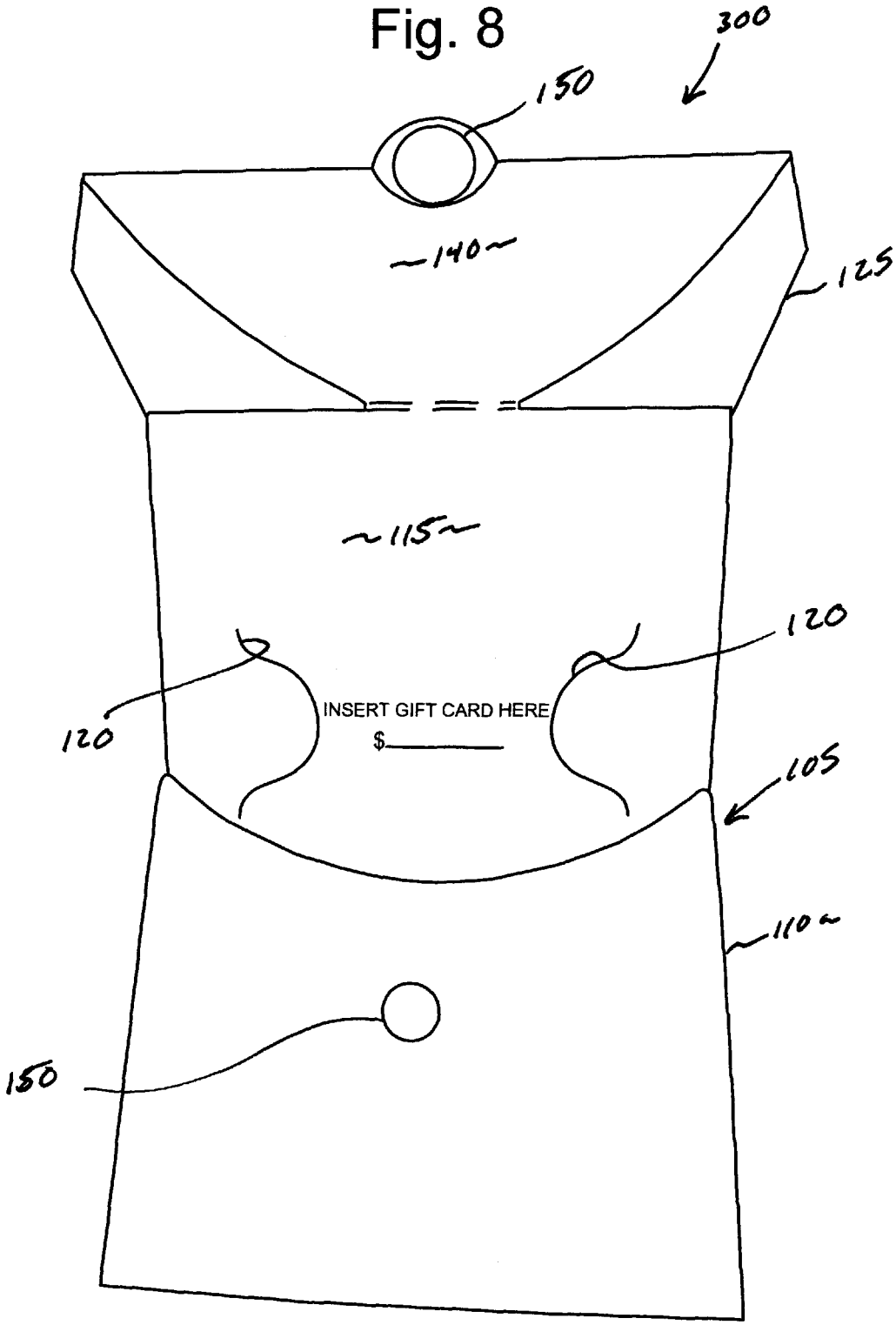
FIG. 8 is a front view of a second alternative embodiment of a sliding panel gift card holder showing the cover flap opened and the carrier panel withdrawn from the holder main body.
Figure 9:
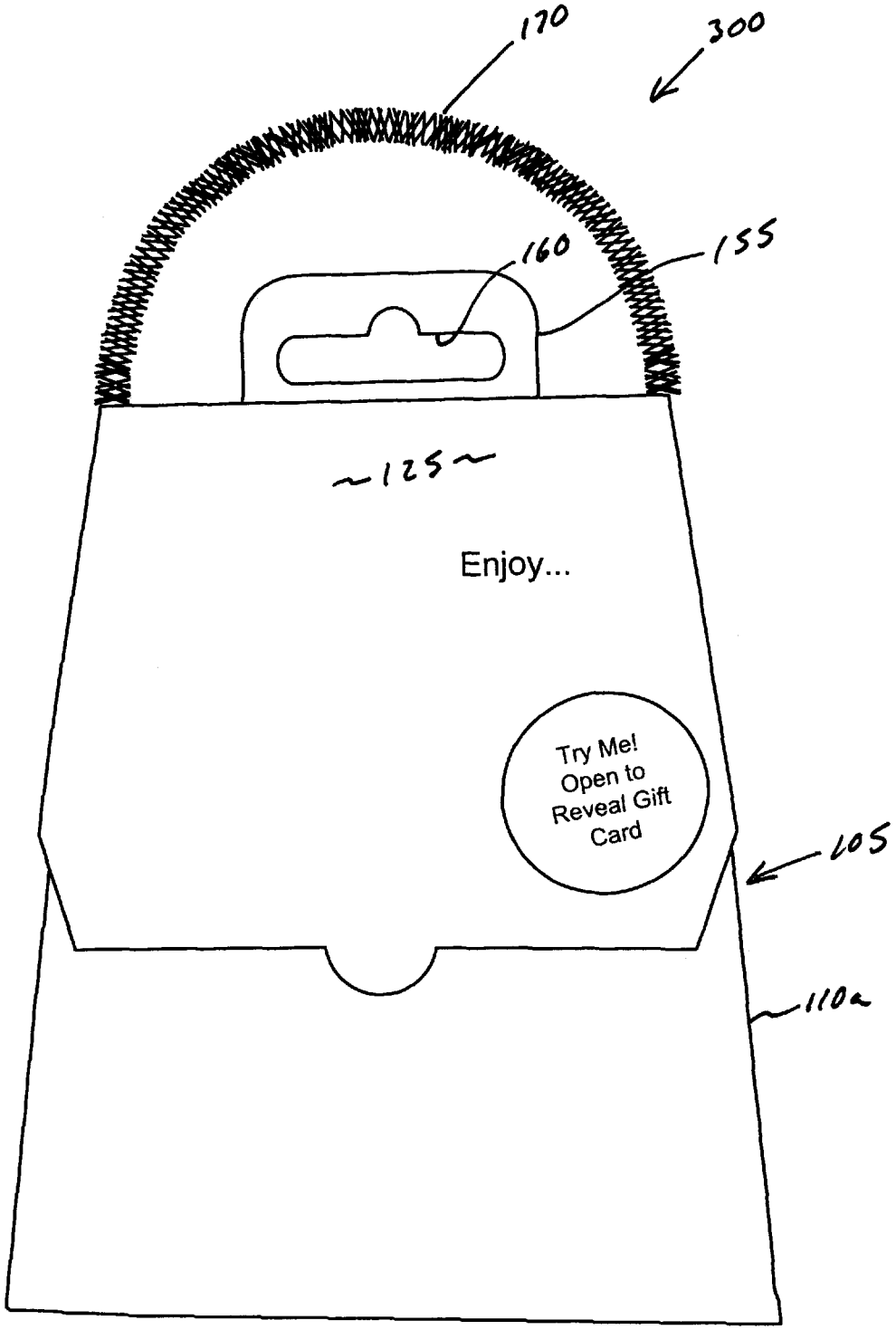
FIG. 9 is a front view showing the cover flap of the holder of FIG. 8 in a closed position.
Figure 10:
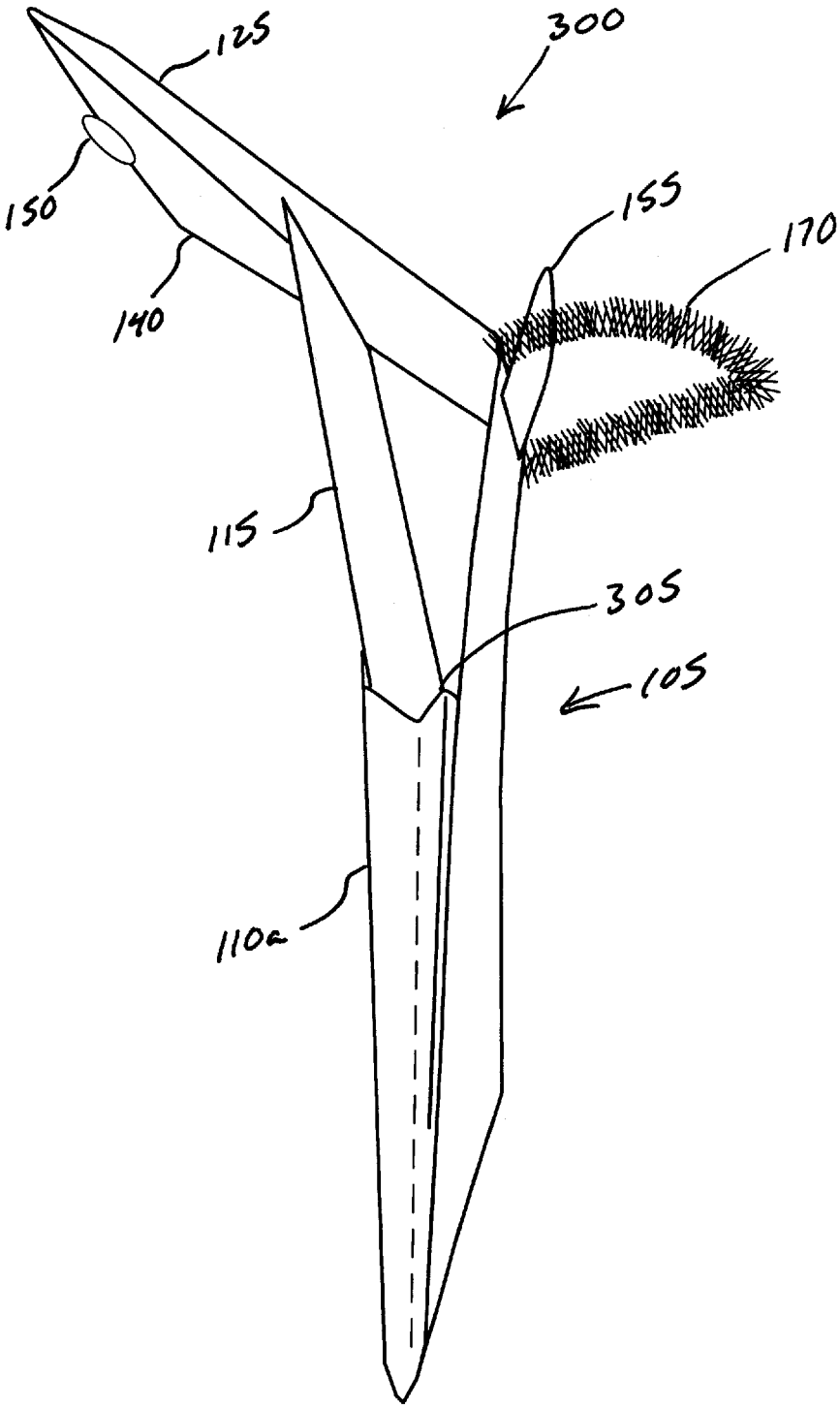
FIG. 10 is a side and partial perspective view showing the holder of FIG. 8 partially opened.
Figure 11:
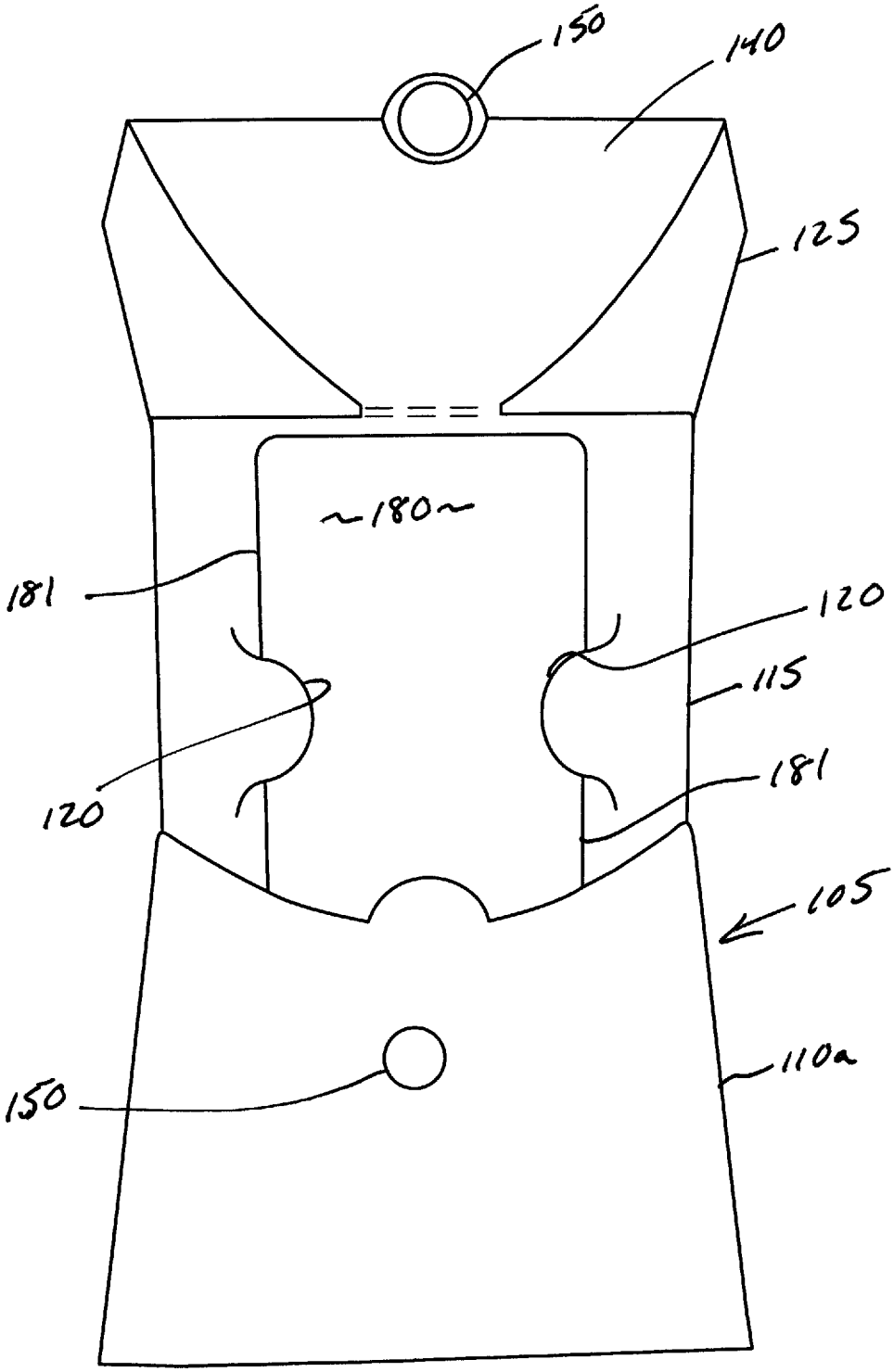
FIG. 11 is a front view of the holder of FIG. 8 showing a gift card mounted on the carrier panel.

FIG. 8 is a front view of a second alternative embodiment of a sliding panel gift card holder 300 similar in structure to the first disclosed embodiment 100. FIGS. 8 through 11 show several views of the holder 300 and, due to close similarities in structure to the first disclosed embodiment, reference numerals and description provided for holder 100 are used in part to identify elements of holder 300. FIG. 8 shows the cover flap 125 opened and the carrier panel 115 withdrawn from the holder main body 105, which comprises a pouch 110*a*. Hook and loop fasteners 150, or other operable means, are provided to retain the cover flap 125 in a closed position. FIG. 9 is a front view showing the cover flap 125 of the holder of FIG. 8 in a closed position. As shown, a hang tag 155 including a sombrero cut aperture 160 may be attached to the back panel of the main body 105 to facilitate hanging the holder 300 on a display stand peg. As also shown, the pouch 110*a* presents an angled profile to mimic a common purse shape. This design may be further enhanced by providing a handle 170 that may be attached to either the main body 105 or the cover flap 125. As shown in the side view of FIG. 10, a pleat 305 may extend on either side from the front to back panels of the main body 105, thereby forming the pouch 110*a* configuration. FIG. 11 is a front view of the holder of FIG. 8 showing a gift card 180 mounted on the carrier panel 115 by inserting longitudinal edges 181 into the slots 120.

Note that drawings are not to scale or to relative scale but are representative of aspects of one or more embodiments of the present invention.

Having thus described the invention, what is claimed as new and desired to be secured by Letters Patent is:

1. A sliding panel transaction card holder comprising:

a main body including a sleeve, the sleeve comprising a front wall and a rear wall, where the front wall is attached to the rear wall on three peripheral sides;

a panel at least partially retained within said sleeve;

slits within said panel for removably attaching a transaction card to said panel;

a cover flap hingedly connected to a rear wall of said sleeve;

a draw flap hingedly connected to said cover flap, and a top edge of said panel hingedly connected to a bottom edge of said draw flap;

whereby, as said cover flap is pivoted away from said main body and from a closed position to an open position, said draw flap follows said cover flap in train and said panel further follows said draw flap in train, thereby sliding at least a portion of said panel out of said sleeve; and wherein the panel is fully obscured by the sleeve when in the closed position and at least partially withdrawn from the sleeve in the open position.

2. The sliding panel transaction card holder of claim 1 wherein said main body comprises side panels forming bellows, wherein the bellows attach the front wall to the rear wall on at least peripheral two sides.

3. The holder of claim 1 wherein the draw flap and the panel have a combined length such that a bottom portion of the panel remains disposed within the sleeve when the cover flap is fully opened.

4. A sliding panel transaction card holder comprising:

a main body, the main body comprising a front wall and a rear wall, where the front wall is attached to the rear wall on two or more peripheral sides;

a carrier panel at least partially retained within said main body;

slits within said carrier panel for removably attaching a transaction card backer sheet to said carrier panel;

a cover flap hingedly connected to a back pane of said main body;

a draw flap hingedly connected to said cover flap, a top edge of said carrier panel hingedly connected to a bottom edge of said draw flap;

whereby, as said cover flap is pivoted away from said main body and from a closed position to an open position, said draw flap follows said cover flap in train and said carrier panel further follows said draw flap in train, thereby sliding at least a portion of said carrier panel out of said main body; and wherein the carrier panel is fully obscured by the main body when in the closed position and at least partially withdrawn from the main body in the open position.

5. The holder of claim 4 wherein the draw flap and the carrier panel have a combined length such that at least a bottom portion of the carrier panel remains disposed within the sleeve when the cover flap is fully opened.

6. A sliding panel transaction card holder comprising:

a main body, the main body comprising a front panel and a back panel, where the front panel is attached to the back panel on two or more peripheral sides;

a carrier panel at least partially retained within said main body;

means for removably attaching a transaction card to said carrier panel;

a cover flap hingedly connected to the back panel of said main body;

a draw flap hingedly connected to said cover flap, a top edge of said carrier panel hingedly connected to a bottom edge of said draw flap;

whereby, as said cover flap is pivoted away from said main body and from a closed position to an open position, said draw flap follows said cover flap in train and said carrier panel further follows said draw flap in train, thereby sliding at least a portion of said carrier panel out of said main body; and wherein the carrier panel is fully obscured by the main body when in the closed position and at least partially withdrawn from the main body in the open position.

7. The holder of claim 6 wherein said main body comprises a pleated bag including the front panel and the back panel and pleated side panels extending between said front panel and said back panel.

8. The holder of claim 6 further comprising a hang tag attached to the back panel of said main body.

9. The holder of claim 6 wherein said main body comprises a pouch presenting a profile to mimic a purse shape.

10. The holder of claim 6 further comprising a handle attached to said main body.

11. The holder of claim 6 further comprising a handle attached to said cover flap.

12. The holder of claim 6 wherein the draw flap and the carrier panel have a combined length such that at least a bottom portion of the carrier panel remains disposed within the sleeve when the cover flap is fully opened.

* * * * *